US010361520B2

(12) United States Patent
Stokoe et al.

(10) Patent No.: US 10,361,520 B2
(45) **Date of Patent: *Jul. 23, 2019**

(54) HIGH DENSITY ELECTRICAL CONNECTOR WITH SHIELD PLATE LOUVERS

(71) Applicant: Amphenol Corporation, Wallingford, CT (US)

(72) Inventors: Philip T. Stokoe, Attleboro, MA (US); Djamel Hamiroune, Nashua, NH (US)

(73) Assignee: Amphenol Corporation, Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/434,865

(22) Filed: Feb. 16, 2017

(65) Prior Publication Data

US 2017/0179652 A1 Jun. 22, 2017

Related U.S. Application Data

(63) Continuation of application No. 14/689,750, filed on Apr. 17, 2015, now Pat. No. 9,608,383.

(51) Int. Cl.
*H01R 13/648* (2006.01)
*H01R 13/6587* (2011.01)
(Continued)

(52) U.S. Cl.
CPC ..... *H01R 13/6587* (2013.01); *H01R 12/727* (2013.01); *H01R 13/6586* (2013.01); *H01R 43/18* (2013.01)

(58) Field of Classification Search
CPC ... H01R 43/18; H01R 12/727; H01R 13/6587
(Continued)

(56) References Cited

U.S. PATENT DOCUMENTS 6,764,349 B2 7/2004 Provencher et al.
6,872,085 B1 3/2005 Cohen et al.
(Continued)

FOREIGN PATENT DOCUMENTS

CN 202550210 U 11/2012
CN 103151626 A 6/2013
CN 103931057 A 7/2014

OTHER PUBLICATIONS

International Search Report and Written Opinion issued in PCT/US16/28108 dated Aug. 30, 2016 (12 pages).

*Primary Examiner* — Khiem M Nguyen
(74) *Attorney, Agent, or Firm* — Blank Rome LLP

(57) ABSTRACT

An electrical assembly has a lead frame with a plurality of elongated conductor sets and an insulative housing. Each conductor set has two differential signal pair conductors between a first ground conductor and a second ground conductor. A slot extends through the insulative housing and at least partially exposes the first ground conductor of a first conductor set and the second ground conductor of a second conductor set. A first ground shield has a first tab bent inward that extends into the slot from a first side of the lead frame. A second ground shield has second tab bent inward that extends into the slot from a second side of the lead frame. A conductive medium is provided in the slot to electrically connect the first tab, the second tab, the first ground conductor and the second ground conductor.

18 Claims, 17 Drawing Sheets

(51) Int. Cl.
*H01R 13/6586* (2011.01)
*H01R 43/18* (2006.01)
*H01R 12/72* (2011.01)

(58) Field of Classification Search
USPC ..... 439/607.06, 607.07
See application file for complete search history.

(56) References Cited

U.S. PATENT DOCUMENTS

| | | | | |
|---|---|---|---|---|
| 7,163,421 | B1 | 1/2007 | Cohen et al. | |
| 7,651,337 | B2 | 1/2010 | McNamara | |
| 7,722,401 | B2 | 5/2010 | Kirk et al. | |
| 7,794,240 | B2 | 9/2010 | Cohen et al. | |
| 8,182,289 | B2 | 5/2012 | Stokoe et al. | |
| 8,398,432 | B1 | 3/2013 | McClellan et al. | |
| 8,512,081 | B2 | 8/2013 | Stokoe | |
| 9,608,383 | B2 * | 3/2017 | Stokoe ..... | H01R 13/6586 |
| 9,660,384 | B2 | 5/2017 | Paniagua | |
| 2009/0035955 | A1 | 2/2009 | McNamara | |
| 2010/0093216 | A1 | 4/2010 | Cohen et al. | |
| 2012/0129394 | A1 | 5/2012 | Davis et al. | |
| 2014/0057493 | A1 | 2/2014 | De Geest et al. | |
| 2014/0342607 | A1 | 11/2014 | Wang et al. | |

* cited by examiner

HIGH DENSITY ELECTRICAL CONNECTOR WITH SHIELD PLATE LOUVERS

RELATED APPLICATION

The present application is a continuation of copending U.S. application Ser. No. 14/689,750, filed Apr. 17, 2015. The entire contents of the above-referenced patent applications are hereby incorporated by reference.

BACKGROUND OF THE INVENTION

Field of the Invention

The present invention relates to electrical interconnections for connecting printed circuit boards.

Background of the Related Art

Electrical connectors are used in many electronic systems. It is commonplace in the industry to manufacture a system on several printed circuit boards ("PCBs") which are then connected to one another by electrical connectors. A traditional arrangement for connecting several PCBs is to have one PCB serve as a backplane. Other PCBs, which are called daughter boards or daughter cards, are then connected to the backplane by electrical connectors.

Electronic systems have generally become smaller, faster, and functionally more complex. These changes mean that the number of circuits in a given area of an electronic system, along with the frequencies at which the circuits operate, continues to increase. Current systems pass more data between printed circuit boards and require electrical connectors that are capable of handling the increased bandwidth.

As signal frequencies increase, there is a greater possibility of electrical noise, such as reflections, cross-talk, and electromagnetic radiation, being generated in the connector. Therefore, electrical connectors are designed to control cross-talk between different signal paths and to control the characteristic impedance of each signal path.

Electrical connectors have been designed for single-ended signals as well as for differential signals. A single-ended signal is carried on a single signal conducting path, with the voltage relative to a common reference conductor representing the signal. Differential signals are signals represented by a pair of conducting paths, called a "differential pair." The voltage difference between the conductive paths represents the signal. In general, the two conducting paths of a differential pair are arranged to run near each other. No shielding is desired between the conducting paths of the pair but shielding may be used between differential pairs.

U.S. Pat. No. 8,512,081 to Stokoe, U.S. Pat. No. 8,182,289 to Stokoe et al., U.S. Pat. No. 7,794,240 to Cohen et al., U.S. Pat. No. 7,722,401 to Kirk et al., U.S. Pat. No. 7,163,421 to Cohen et al., and U.S. Pat. No. 6,872,085 to Cohen et al., are examples of high density, high speed differential electrical connectors. Those patents provide a daughtercard connector having multiple wafers with signal and ground conductors. The wafer conductors have contact tails at one end which mate to a daughtercard, and mating contacts at an opposite end which mate with contact blades in a shroud. The contact blades, in turn, have contact tails which mount to connections in a backplane.

SUMMARY OF THE INVENTION

It is an object of the invention to provide enhanced shielding for conductors. It is a further object to provide shield plates with louvers that bend inward toward the lead frame to shield the signal conductors of the lead frame and provide a common ground to the ground conductors of the lead frame.

Accordingly, an electrical assembly is provided having a lead frame sandwiched between two ground shields. The lead frame has a plurality of elongated conductor sets and an insulative housing. Each conductor set has two differential signal pair conductors between a first ground conductor and a second ground conductor. The lead frame has a first side and a second side opposite the first side. A slot extends completely through the insulative housing to define a first opening on the first side of the lead frame and a second opening on the second side of the lead frame. The slot is positioned between a first and second neighboring conductor sets and at least partially exposing the first ground conductor of the first conductor set and the second ground conductor of the second conductor set.

A first ground shield extends along and parallel to the first side of the lead frame. The first ground shield has a first main body and a first tab bent inward from the first main body into the first opening of the slot of the lead frame. A second ground shield extends along and parallel to the second side of the lead frame. The second ground shield has a second main body and second tab bent inward from the second main body into the second opening of the slot of the lead frame.

A conductive material is provided in the insulator and ground conductor slots, connecting electrically the first tab, the second tab, the first ground conductor and the second ground conductor while adding mechanical integrity to the assembly.

In addition, the invention provides a backplane connector having panel inserts. The panel inserts couple with the ground shields of two neighboring wafers to provide a common ground for those wafers.

These and other objects of the invention, as well as many of the intended advantages thereof, will become more readily apparent when reference is made to the following description, taken in conjunction with the accompanying drawings.

DETAILED DESCRIPTION OF THE PREFERRED EMBODIMENTS

Figure 1:
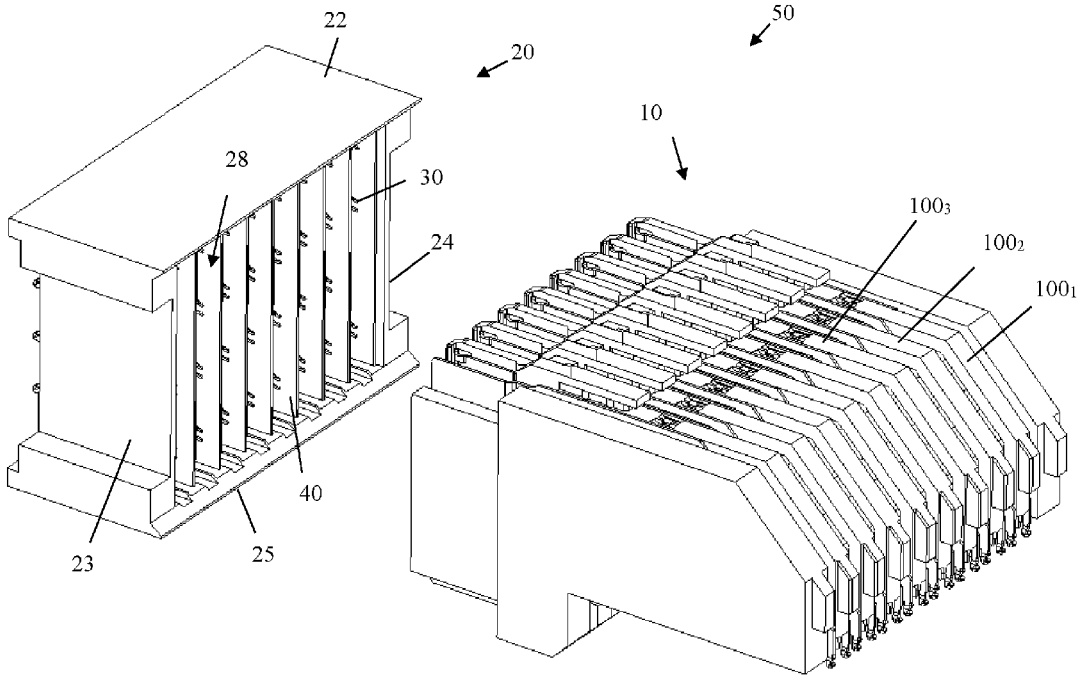
FIG. 1 is a perspective view of the electrical interconnection system in accordance with the invention, including a daughter card connector and a shroud.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes, it being understood that the invention may be embodied in other forms not specifically shown in the drawings.

Turning to the drawings, FIG. 1 shows a Right Angle Daughter Card Back Plane mounted electrical interconnection system 50 having a 4×8 differential pair configuration having either a lead free surface mount or press fit application. The system 50 includes a daughter card connector 10 and a backplane connector 20. The backplane connector 20 connects to a backplane or printed circuit board (PCB) (not shown). The daughter card connector 10 has multiple daughter card wafer pairs or wafer assemblies 100 that each mate with the backplane connector 5 and connects to a daughter card (not shown). The wafers 100 are substantially parallel to each other. The daughter card connector 10 creates electrical paths between a backplane and a daughter card. Though not expressly shown, the interconnection system 50 may interconnect multiple daughter cards having similar daughter card connectors that mate to similar backplane connectors on the backplane. The number and type of subassemblies connected through the interconnection system 50 is not a limitation on the invention.

Accordingly, the invention is preferably implemented in a wafer connector having mating contacts. However, the invention can be utilized with any connector and mating contacts, and is not limited to the preferred embodiment. For instance, the present invention can be implemented with the connectors shown in U.S. Pat. No. 7,794,240 to Cohen et al., U.S. Pat. No. 7,722,401 to Kirk et al., U.S. Pat. No. 7,163,421 to Cohen et al., and U.S. Pat. No. 6,872,085 to Cohen et al., the contents of which are hereby incorporated by reference.

The backplane connector 20 is in the form of a shroud or housing 22 that houses backplane contacts 30. The housing 22 has a front wall 23, a rear wall 24, and two opposite side walls 25, which form a closed rectangular shape and form an interior space. One or more panel inserts 40 are provided in the interior space of the shroud 22. As shown, the panel inserts 40 extend from one side wall 25 to the opposite side wall 25 arranged in rows, which are parallel with each other and with the front and rear walls 23, 24 of the shroud 20. Channels 28 are formed between the panel inserts 40, and each wafer pair 100 is received in one of the channels 28 respectively, to be parallel to each other. The shroud 22 is preferably made of an electrically insulative material. The backplane contacts 30 are positioned along each panel insert 40 within the channels 28, and/or along the inside surfaces of the front and rear walls 23, 24, in parallel planes. The backplane contacts 30 are preferably in the form of flexible beam contacts that extend up through the floor of the shroud 22 and have contact tails that extend out of the bottom of the shroud 22. The backplane contacts 30 may extend through supporting structures disposed in the shroud 22.

Figure 2A:
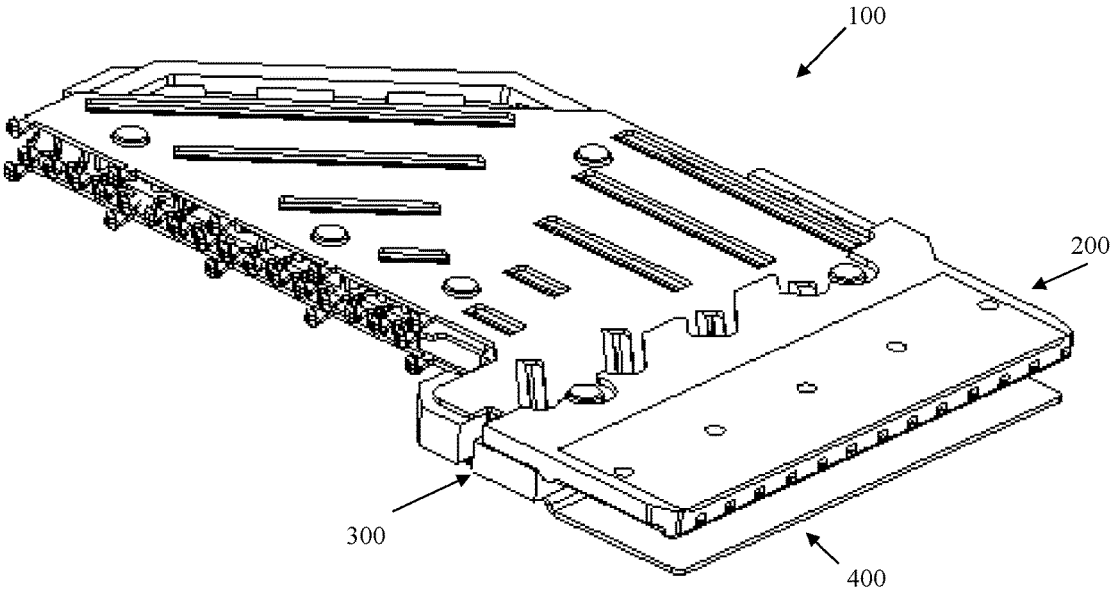
FIG. 2A is a perspective view of a wafer of the daughter card connector of FIG. 1.
Figure 2B:
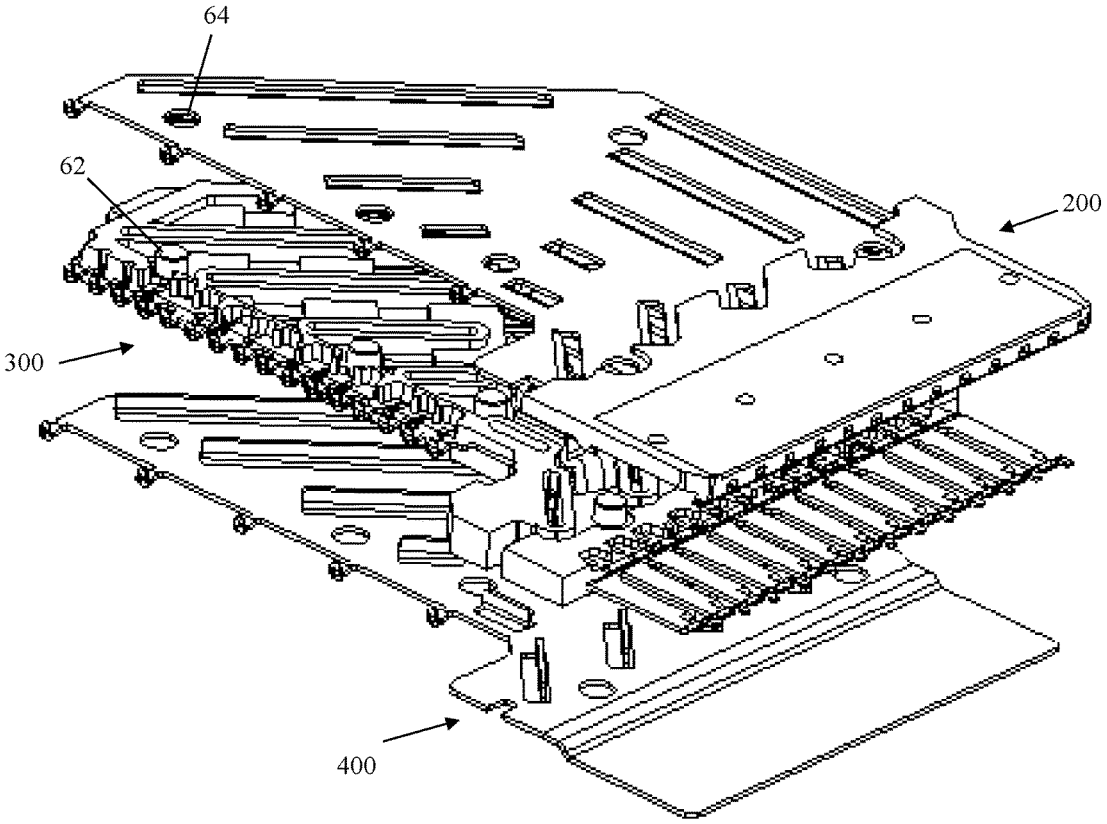
FIG. 2B is an exploded view of the wafer of FIG. 2A.

The assembly of the daughter card wafer assembly 100 is shown in greater detail in FIGS. 2A, 2B. The wafer 100 has a first ground shield 200, an insert molded center lead frame assembly 300, and a second ground shield 400. As shown, the center lead frame assembly 300 is sandwiched between the first and second ground shields 200, 400. Each of the lead frame assembly 300, first ground shield 200, and second ground shield 400 are thin and lie in a respective plane that is substantially parallel to the planes of the other two components.

Figure 3A:
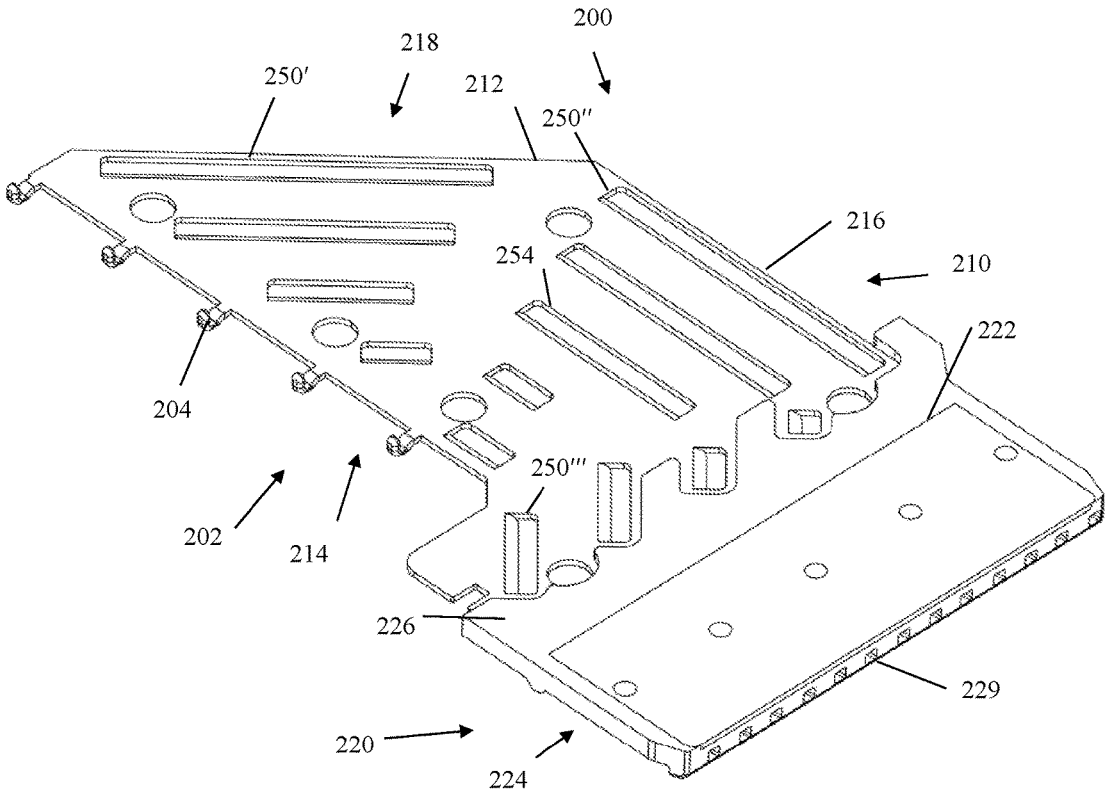
FIG. 3A is a top perspective view of the first ground shield of FIGS. 2A, 2B.

The first ground shield 200 is shown in greater detail in FIG. 3A. The ground shield 200 has a main body section 210, a first contact mating section 202 and a second contact mating section 220. The main body section 210 is a thin metal plate having an outer or outward-facing side or surface 212 and an inner or inward-facing side or surface 214. The outer surface 212 forms the external side of the assembled wafer 100 and faces away from the lead frame assembly 300, and the inner surface 214 is on the interior of the assembled wafer 100 and faces toward the lead frame assembly 300. The ground shield 200 has a first leading or contact edge at the second contact mating section 202 along one side and forms the first contact mating section 220 along another side. The main body section 210 has a straight section 216 and an angled section 218, which together form a 90° turn so that a leading edge of the second contact mating section 220 is substantially orthogonal to a leading edge 228 of the first contact mating section 202. A plurality of contacts 204 are formed spaced apart along at least a portion of the first leading edge 202. The contacts 204 project outward from the leading edge 202 and can be upturned.

Figure 3B:
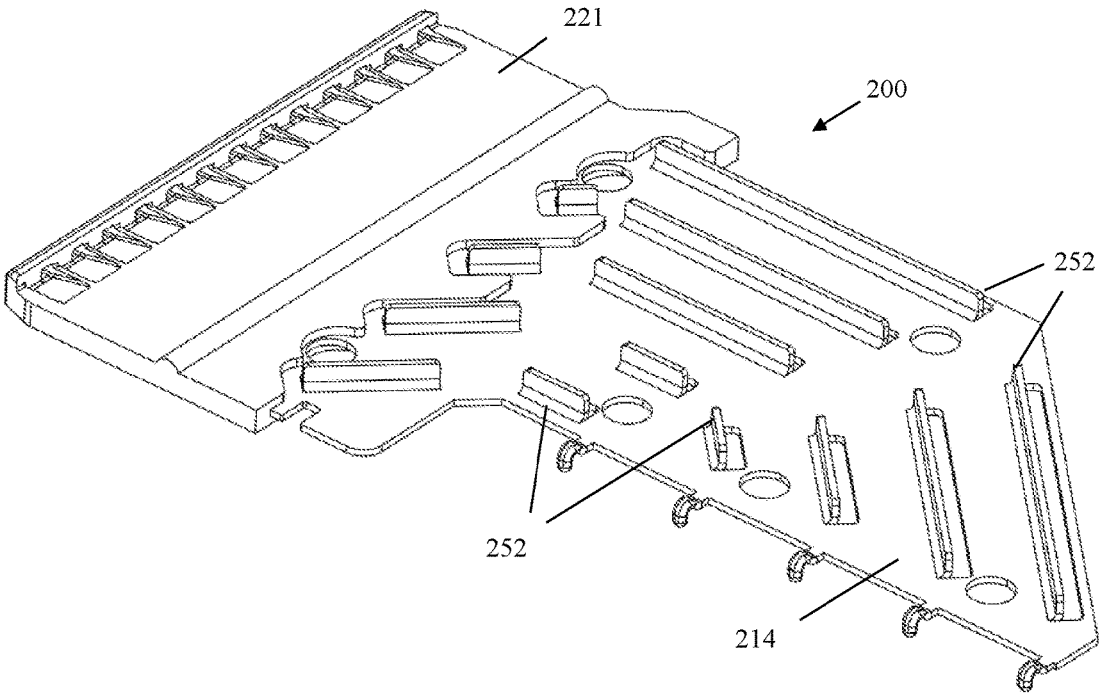
FIG. 3B is a bottom perspective view of the first ground shield of FIG. 3A.

Louvers 250 are formed in the main body section 210. The louvers 250 are thin elongated members that are formed by stamping or cutting the main body section 210, creating a tab portion 252. The tab portion 252 is then bent along an axis or hinge 254 so that the tab portion 252 extends out of the main body section 210. As best shown in FIG. 3B, the tab portion 252 extends downward with respect to the outer surface 212, and outward from the inner surface 214. As shown, multiple louvers 250' can be formed in the straight section 216, and multiple louvers 250", 250'" can be formed in the angled section 218 of the main body 210, with the louvers 250 being spaced apart and substantially parallel to one another in each of the sections 216, 218 and also substantially parallel to the outer edge of the main body 210. The louvers 250 can be of varying size as space permits, with the larger louvers 250 being located toward the outer edge of the main body 210 and the smaller louvers 250 being located toward the inner edge by the contact leading edge 202. The louvers 250' in the angled section 218 can be at an angle with respect to the louvers 250" in the straight section 216. The straight section 216 has a lower portion that can also have multiple louvers 250'" that are formed at an angle with respect to the louvers 250" in the upper portion of the straight section 216. The louvers 250 are preferably elongated to have a rectangular shape. Though multiple louvers 250 are shown, fewer louvers 250 can be provided though preferably at least one louver 250 is provided.

The main body 210 includes the first contact mating section 202, the angled section 218, and the straight section 216. The second contact mating section 220 is continuous and integral with the main body 210, so that the ground shield 200 forms a single continuous integral member. A bend 222 is provided between the main body 210 and the second contact mating section 220, so that the second contact mating section 220 is offset from and substantially parallel to the main body 210. An insulative housing 226 is partly shown formed about the contact section 220. The contact mating section forms a leading edge 228. Openings 229 are provided in the insulative member 226 to provide an initial mating contact force and positions the contacting beam 302.

Figure 3C:
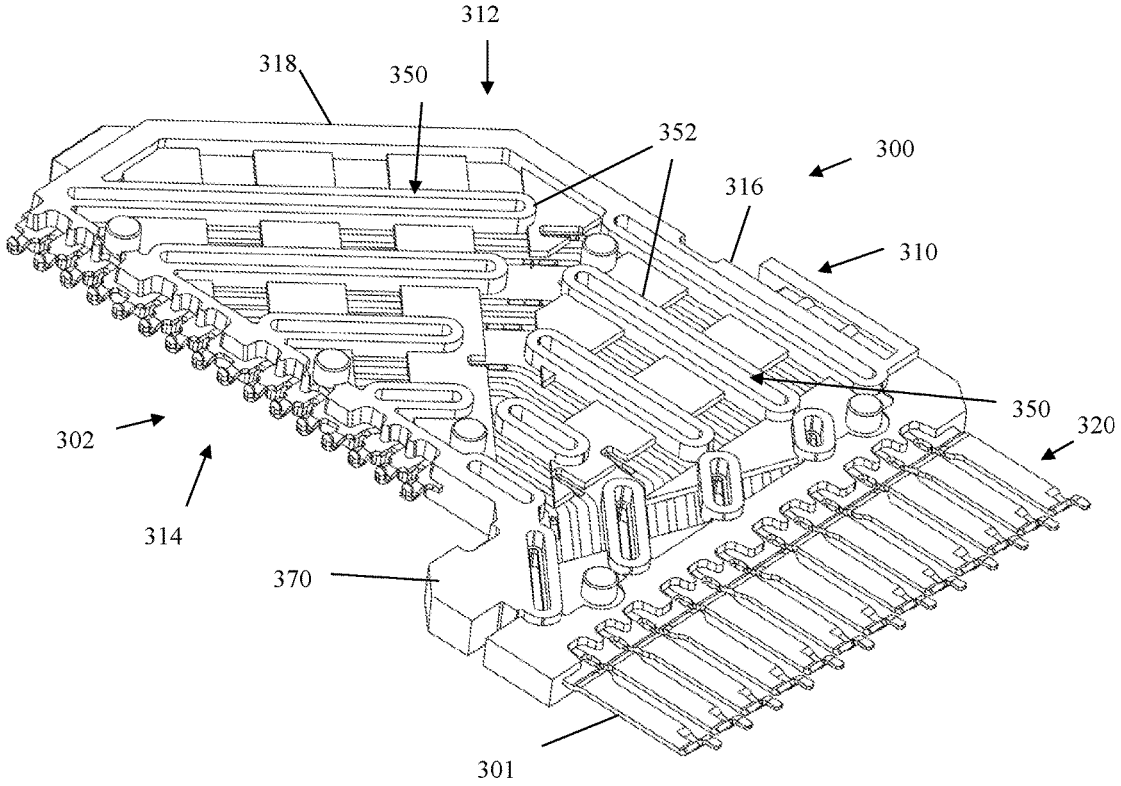
FIG. 3C is a perspective view of the lead frame assembly of FIGS. 2A, 2B.
Figure 3D:
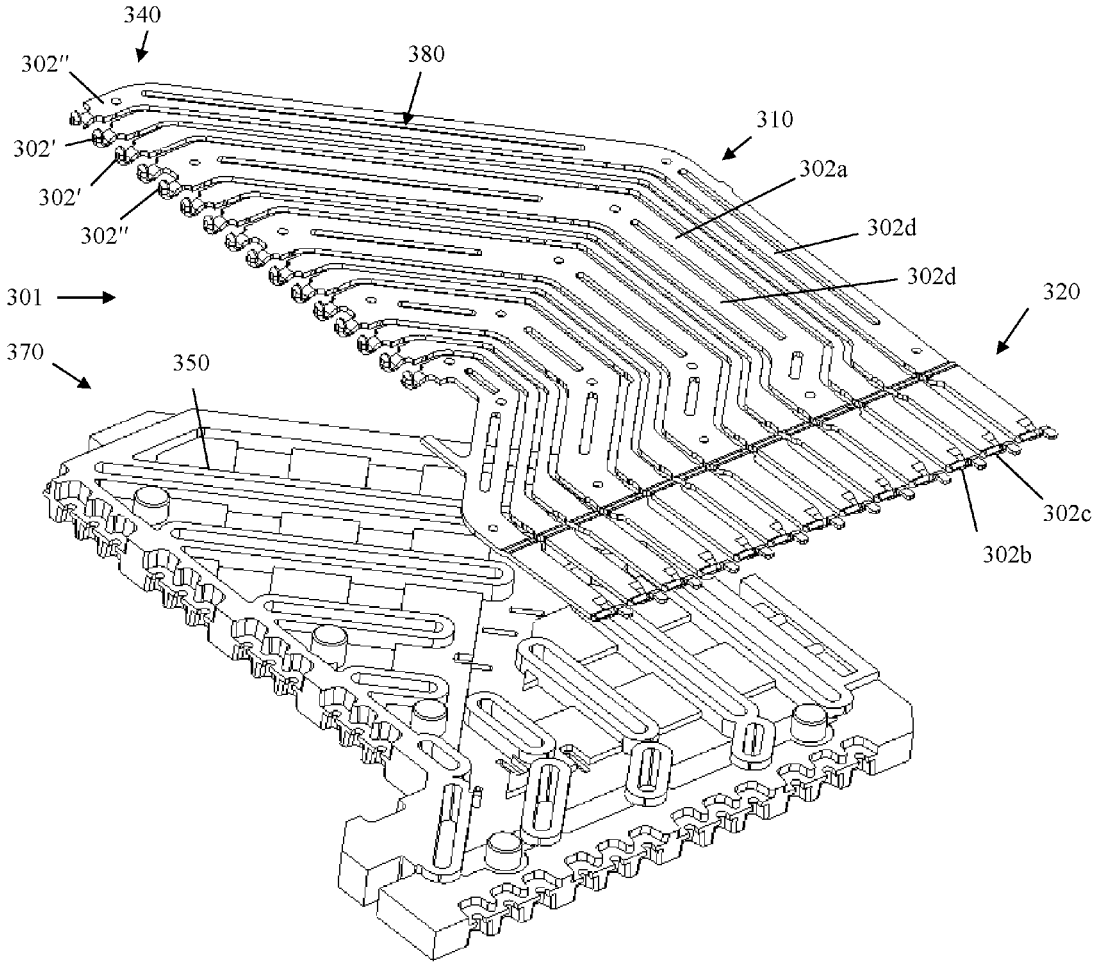
FIG. 3D is a perspective exploded view of the lead frame assembly of FIG. 3C.
Figure 5:
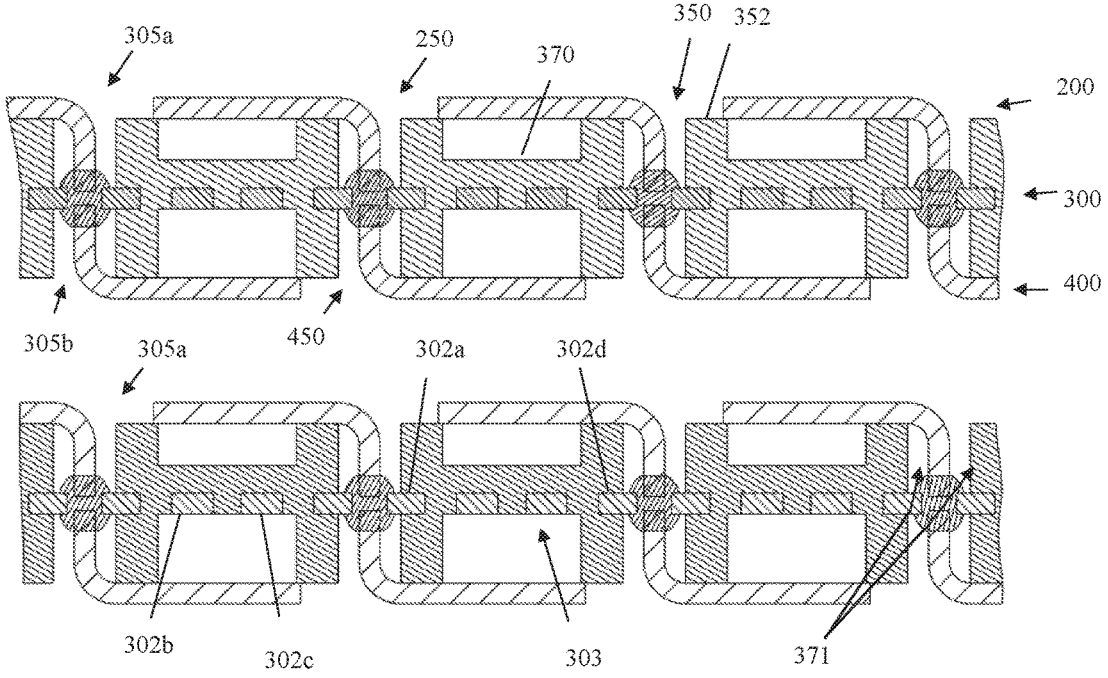
FIGS. 5-6 are cross-sectional view of the slot mating sections of the wafers.

Turning to FIGS. 3C, 3D, the lead frame assembly 300 is shown in further detail. As best shown in FIG. 3D, the lead frame assembly 300 has a lead frame 301 and an insert molded insulative housing 370. The lead frame assembly can be formed by pouring a liquid insulative material over the lead frame 301 in a mold, so that the insulative housing 370 is formed about the lead frame 301. The lead frame 301 is shown separate from the housing 370 for purposes of illustration. However, the lead frame assembly 300 is formed by molding the insulative housing 370 around the lead frame 301, so that that lead frame 301 is embedded in the housing 370, as shown in FIG. 5.

The lead frame assembly 300 has an intermediate section 310 and contact mating sections 320, 340. The intermediate section 310 of the lead frame assembly 300 has a straight section 316 and an angled section 318. The angled section 318 is straight, but formed at an angle to straight section 316. The lead frame 301 includes a plurality of thin, elongated conductors 302 (also referred to as conductive members or conductive leads) that extend from the first contact mating section 320 to the leading edge 304 of the second contact mating section 340. The conductors 302 extend substantially parallel to each other. The lead frame assembly 300 is formed as a right-angle connector, with the first contact mating section 320 facing substantially perpendicular to the second contact mating section 340, such that the first contact mating section 320 has an insertion/mating direction that is perpendicular to the insertion/mating direction of the second contact mating section 340.

In the illustrated embodiment, there are two signal conductors 302' located next to each other, with ground conductors 302" on either side of the signal conductors 302'. The ground conductors 302" are at least twice as wide as the signal conductors 302'. The ground conductors 302" have an elongated slot 380 in the straight section 316 and the angled section 318, which splits the ground conductor 302" in half to form two ground conductor sections 302*a*, 302*d* in each section 316, 318 of the ground conductor 302". Accordingly, the lead frame 301 has a ground conductor 302" alternating with a differential signal conductor pair 302' (i.e., two signal conductor 302', one carrying a positive signal and the other carrying a negative signal).

The insulative housing 370 at least partially encloses the conductors 302, and particularly the intermediate sections 310 of the conductors 302. The two contact mating sections 320, 340 of the conductors 302 can be exposed and not enclosed in the housing 370 or are otherwise accessible to connect with a mating contact. The insulative housing 370 holds the conductors 302 in place, protects the conductors 302, and reduces electrical interference of the electrical signals on the conductors 302. Though a single insulative housing 370 is shown mating with one side of the lead frame 301, another insulative housing can be provided on the opposite side of the lead frame 301 such that the lead frame 301 is sandwiched between the insulative housings. Or, the lead frame 301 can be embedded within the insulative housing 301.

A plurality of elongated slots 350 are formed in the insulative housing 370. A ridge 352 can optionally be provided to extend at least partly or fully around the outer circumference of each slot 350. Each slot 350 passes completely through the insulative housing 370 and defines an opening on the top surface 312 of the housing 370 and the bottom surface 314 of the housing 370. The slots 350 and ridges 352 can be formed at each of the contact mating section 320, straight section 316 and angled section 318. And, the ridges 352 are formed on both the top surface 312 and on the bottom surface 314 of the lead frame 400. The ridges 352 project outward from the top and bottom surfaces 312, 314. The ridges 352 protect the slot and provide a support surface on which the mating ground shield 200, 400 can rest.

Figure 3E:
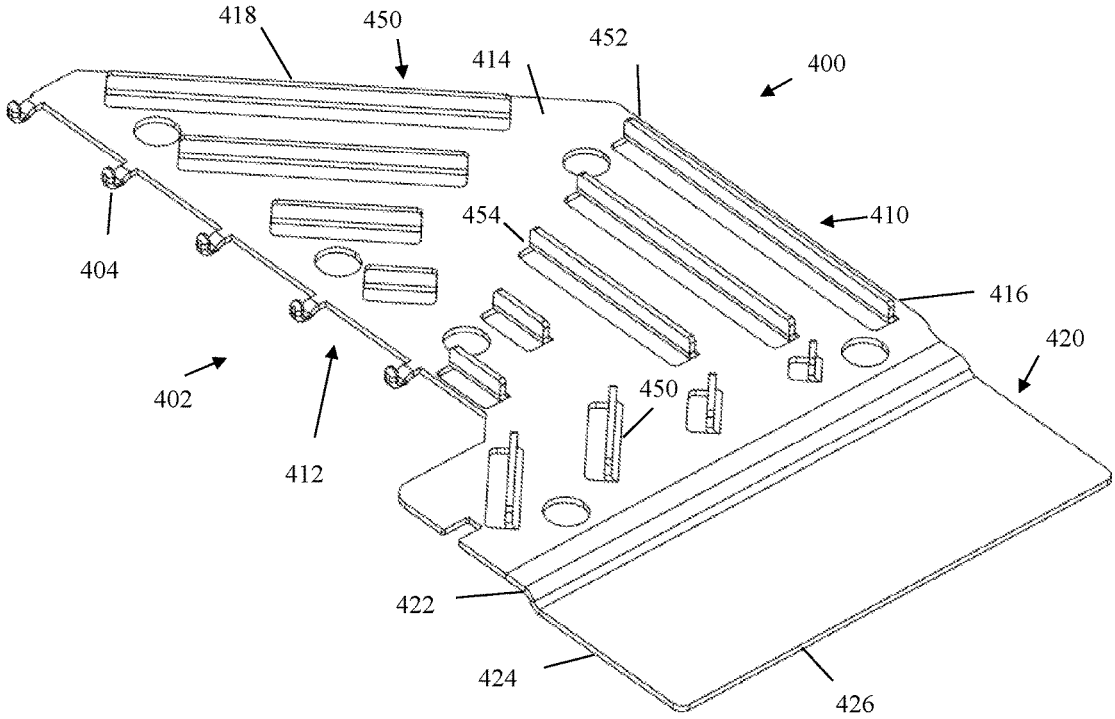
FIG. 3E is a perspective view of the second ground shield of FIGS. 2A, 2B.

The second ground shield 400 is shown in FIG. 3E. The second ground shield is substantially the same as the first ground shield 200, which is shown and described above with respect to FIGS. 3A, 3B. Accordingly, the second ground shield 400 has the same features and elements as the first ground shield 200, including a main body section 410 with a straight section 416 and an angled section 418; and contact mating section 420 with a leading edge 426, outer surface 412, inner surface 414 contact leading edge 402, contacts 404; and louvers 450 having tabs 452 and hinges 454. The description of those elements of the second ground shield 400 is the same as the respective elements of the first ground shield 200. More specifically, the contact mating section 420 has a bend portion 422 and a flat portion 424, as with the ground shield 200. The bend portion 422 has a slight bend that offsets the flat portion 424 from the straight section 416, with the flat portion 424 being substantially parallel to the straight section 416. The flat portion 424 forms the leading edge 426.

As best illustrated in FIGS. 2A, 2B, the lead frame assembly 300 is sandwiched between the first ground shield 200 and the second ground shield 400. Thus, the lead frame 200, the first ground shield 200 and the second ground shield 400 are each substantially the same size and shape as one another. Accordingly, the slots 350 on the insulative housing 370 of the lead frame assembly 300 are aligned with the louvers 250 on the first ground shield 200, and with the louvers 450 on the second ground shield 400.

Turning to FIG. 4, the assembly of the wafer 100 (FIG. 2A) is shown. Starting with FIG. 4A, the louver 250 from the first ground shield 200 is depicted, with the tab 252 extending outward (upward in the embodiment shown) with respect to the inner surface 214 of the main body 210. Moving to FIG. 4B, the lead frame assembly 300 is joined with the first ground shield 200. The slot 350 is aligned with the ground conductor 302", so that the tab 252 is aligned with the ground conductor slot 380 in the ground conductor 302" between the two ground conductor sections 302*a*, 302*d*.

As shown, the slot 350 has openings 353, 355 on opposite sides of the lead frame assembly 300, with a first opening 353 on the top side 312 of the lead frame assembly 300 and a second opening 355 on the bottom side 314 of the lead frame assembly 300. The lead frame assembly 300 has a top ridge 352" with two opposing sides 352*a*", 352*b*" on the top surface 316 and a bottom ridge 352' with two bottom ridges 352*a*', 352*b*' on the bottom surface 314, with the slot 350 extending between the respective top ridge sides 352*a*", 352*b*" and the two respective bottom ridge sides 352*a*', 352*b*'. In addition, the conductors 302 are shown partially embedded in the insulative housing 370. As best shown in FIG. 5, there are two ground conductors 302*d*, 302*a* exposed at each slot 350. Each of the ground conductors 302*d*, 302*a* are associated with an adjacent differential conductor signal pair that has a positive conductor 302*b* and a negative conductor 302*c*.

Returning to FIG. 4B, the inner surface 214 of the first ground shield 200 rests on the bottom ridges 352*a*', 352*b*', and the louver 250 is aligned with the bottom side of the slot 350. The tab 252 and conductors 302*a*, 302*b* form a mating region 351 within the slot 350. Here, the tab 252 of the first ground shield 200 extends upward (in the embodiment shown) substantially perpendicularly to the inner surface 214, into the mating region 351 of the slot 350 from the bottom opening 353 and between the two bottom ridges 352*a*', 352*b*'. The tab 252 extends just about to the ground conductors 302*d*, 302*a*, and can slightly overlap with the two ground conductors 302*d*, 302*a*, so that the tab 252 is adjacent to the conductors 302*d*, 302*a* and can be aligned with the conductors 302*a*, 302*b*.

Figure 4A:
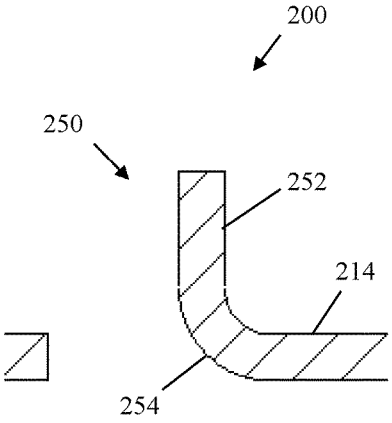
FIGS. 4A, 4B, 4C, 4D are cross-sectional views of a single slot mating section of the wafer of FIGS. 2A, 2B.
Figure 4B:
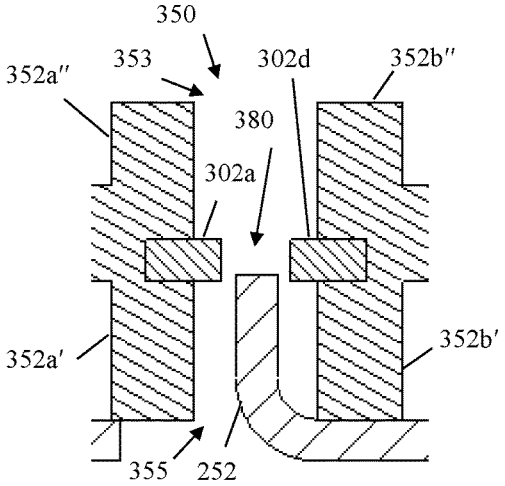
Figure 4C:
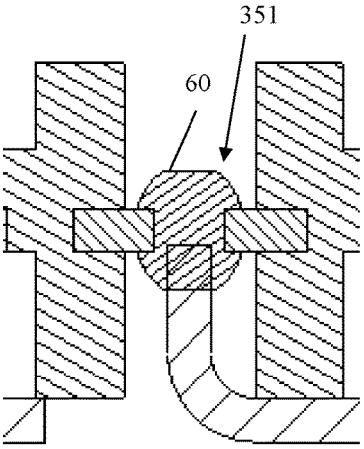
Figure 4D:
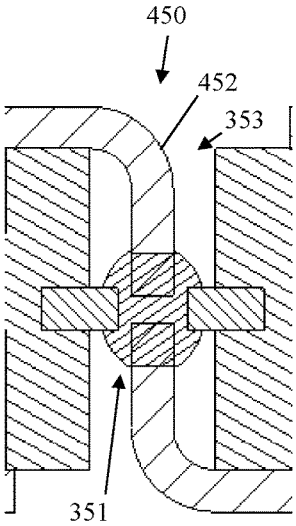

Referring now to FIG. 4C, a conductive material 60 is dispensed into the mating region 351 of the slot 350 (such as by a needle-type injector or a drop feed) and onto the distal end of the tab 252 and the exposed portions of the conductors 302*d*, 302*a*. Turning to FIG. 4D, the second ground shield 400 is assembled over the top of the lead frame assembly 300. Accordingly, the inner surface 414 of the second ground shield 400 rests on the top ridges 352*a*", 352*b*" of the lead frame assembly 300, and the louver 450 is aligned with the top side 312 of the slot 350. The tab 452 of the second ground shield 400 extends downward (in the embodiment shown) substantially perpendicularly to the inner surface 414, into the slot 350 from the top opening 353 and between the two top ridges 352*a*", 352*b*". The tab 452 extends just about to the conductors 302*d*, 302*a*, and can slightly overlap with the conductors 302*d*, 302*a*, so that the tab 452 is adjacent to the conductors 302*d*, 302*a* and can be aligned with the conductors 302*d*, 302*a*. In addition, when the second ground shield 400 is fully seated on the lead frame assembly 300, the distal end of the tab 452 extends conductive material 60. As shown, the tabs 252, 452 are close to, but slightly spaced from, the ground conductors 302*d*, 302*a*, so that the conductive material 60 can reliably contact the tabs 252, 452 and the conductors 302*d*, 302*a*. The conductive material 60 has a coefficient of expansion that is very similar to the metal of the conductors 302 and the shields 200, 400, so that the conductive material 60 is compatible with the conductors 302 and shield 200, 400 at all temperatures.

The conductive material 60 electrically connects the tabs 252, 452 with the conductors 302*d*, 302*a*. The conductive material 60 can be provided along the entire length of the tabs 252, 452, or can be provided at one or more spots along the length of the tabs 252, 452. Once the first ground shield 200, lead frame 300, and second ground shield 400 are fully assembled on each other, the wafer 100 is further processed to ensure the conductive material 60 bonds/couples the louvers 250, 450 with the conductors 302*d*, 302*a*, and also bonds the first and second ground shield 200, 400 with the lead frame 300. In the present embodiment, the conductive material 60 is applied after the first louver 250 is positioned. This creates more surface for the conductive material 60 to bond to so that it does not escape from the conductors 302*d*, 302*a* and the slot 350. In addition, the first louver 250 forms a support surface so that the conductive material 60 does not get pushed out of the slot 350 when the second louver 450 enters the slot 350. In addition, the gaps between the conductors 302*a*, 302*d* and the first louver 250 are sized so that the surface tension of the conductive material 60 prevents the conductive material 60 from migrating out of the slot.

As discussed above with respect to FIGS. 3C, 3D, an elongated slot 380 is provided in at least the straight section 316 and the angled section 318 of the ground conductors 302". That creates the two ground conductor sections 302*a*, 302*d* in each of those sections 316, 318. As a result, the tab portions 252, 452 of the louvers can both be coupled with the ground conductor sections 302*a*, 302*d* from one side of the wafer, as shown. In an alternative embodiment, the sections 316, 318 can be solid (without an elongated slot 380 or an opening of any sort). However, that would require the first louver 250 to be coupled to the ground conductor by a first conductive element from one side of the wafer, and the second louver 450 to be coupled to the opposite side of the ground conductor by a second conductive element, where the wafer might have to be turned over during each process.

Figure 6:
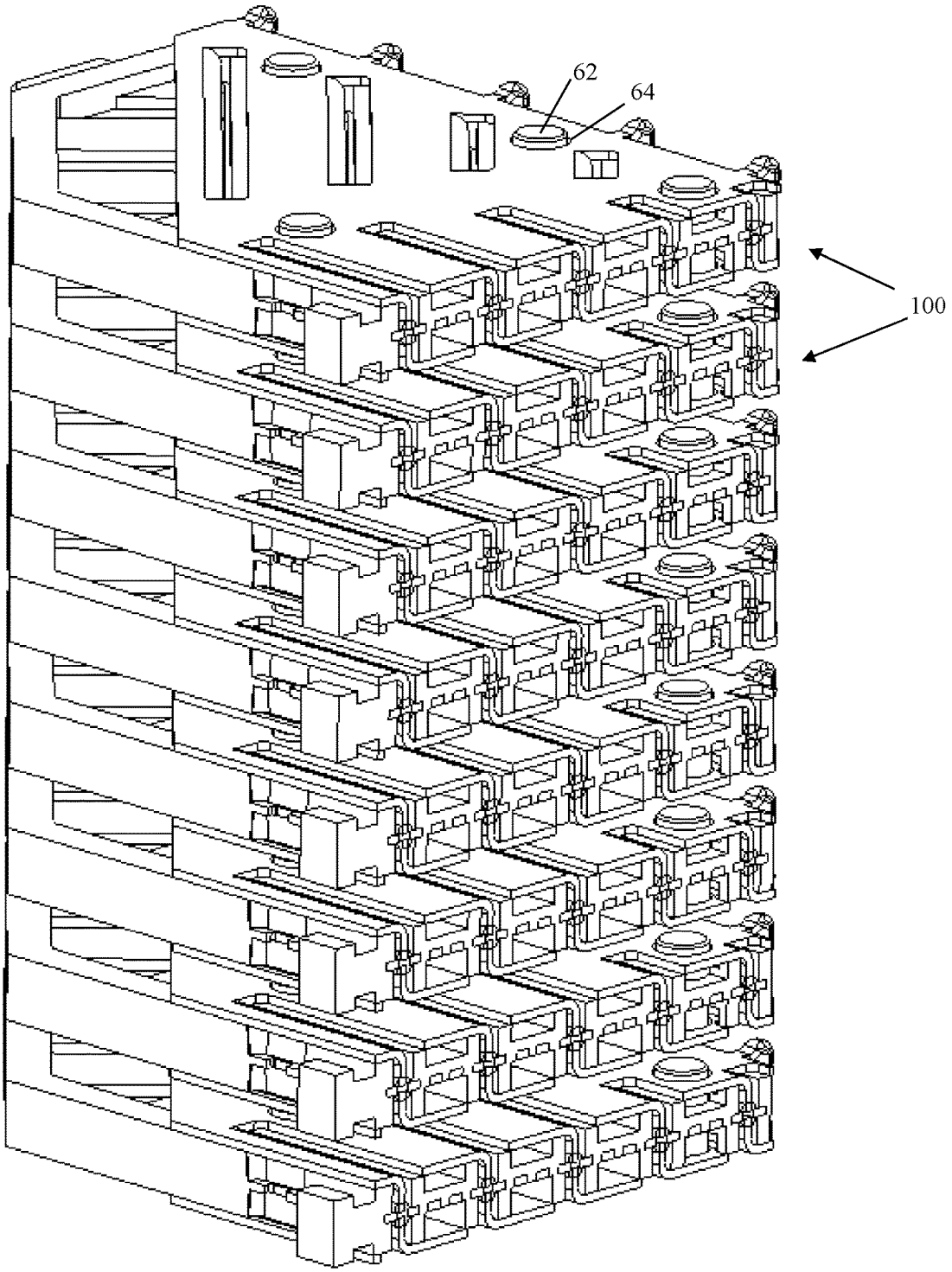

The wafer 100 is more completely shown in FIGS. 5, 6. Here, a plurality of wafers 100 are shown positioned parallel to each other. The wafer 100 provides increased shielding to the differential signal pair conductors 302*b*, 302*c* (having a positive signal conductor and a negative signal conductor), which are surrounded on all four sides by commoned elements. Thus, the invention provides a 4-sided, coaxial cable-like shielding for each differential signal pair conductors. The differential signal pair conductors 302*b*, 302*c* are shielded on either side by the ground conductors 302*a*, 302*b* and the ground tabs 250, 450. This provides shielding to reduce crosstalk or other interference between neighboring signal pair conductors 302*b*, 302*c* in the same wafer 100. And the differential signal pair conductors 302*b*, 302*c* are shielded on the top and bottom by the ground shields 200, 400. This provides shielding to reduce crosstalk or other interference between signal conductors 302*b*, 302*c* from the neighboring wafer 100.

In addition, the invention provides a common ground throughout the entire wafer 100. The two shields 200, 400 (the external grounds) are connected together. And the ground conductors 302*a*, 302*d* (internal grounds) are connected together. And the ground conductors 302*a*, 302*d* are connected to the shields 200, 400. This provides a more uniform ground throughout the wafer 100, which provides a more reliable electrical signal on the differential signal pair 302*b*, 302*c*.

FIG. 5 also illustrates the alignment of the slots 350 and ridges 352 to the louvered tabs 252, 452. Cross-referencing to FIGS. 3D and 5, the slots 350 are aligned with the slot 380 in the ground conductors 302". The signal conductors 302' rest on the insulative housing 370 between the ridges 352. The signal conductors 302' can be received in respective channels 303 to maintain the proper spacing between the conductors 302. In addition, FIG. 5 shows that the ridges 352 form an H-shape with a space 371 between the respective ridges 352. The ground shield spans those spaces 371, such that the ridges 352 maintain the ground shield at a distance to provide a proper spacing between the signal conductors and the ground conductors. The ridges 352 and spacing 371 also minimize any change in shape if the wafer is heated, and the spacings 371 minimize the amount of insulative housing.

It is noted that the louvers 250 are bent from the right side of the embodiment, and therefore are hinged 254 on the right side; whereas the louvers 450 are bent from the left side of the embodiment and are hinged 454 on the right side. The alternating apertures created by the louvers 250, 450 in shields 200, 400 minimizes wafer 100 to wafer 100 signal interference. That is, the aperature 305*b* created by the bent tab 452 in the top wafer 100 is offset from and does not align with the aperature 350*a* created by the bent tab 252 in the bottom wafer 100. That minimizes wafer-to-wafer crosstalk and signal interference.

Figure 7:
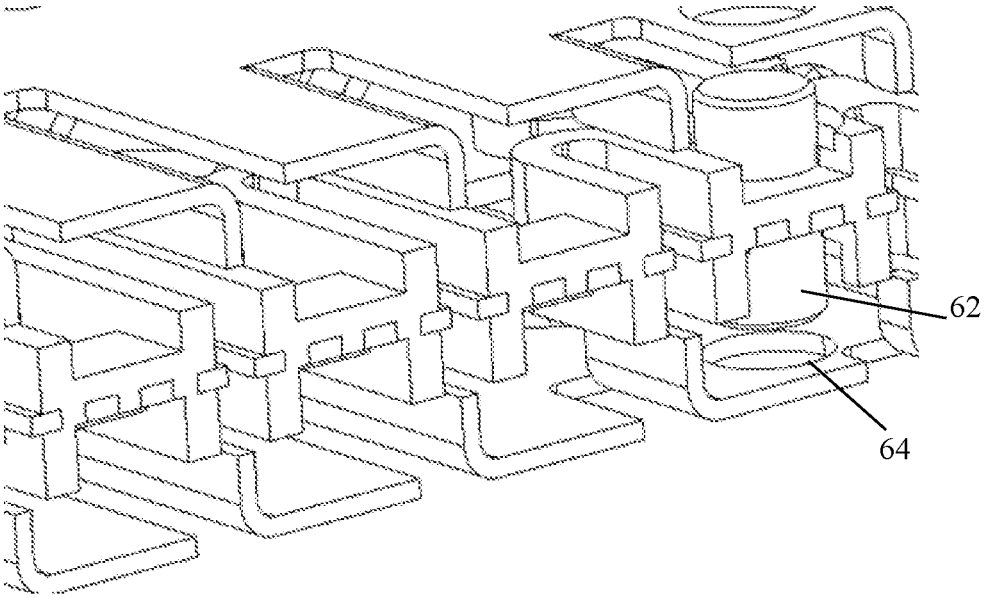
FIG. 7 is a slightly exploded view of the ground shields being assembled on the lead frame with the alignment pin and opening.

Turning to FIG. 7, one or more alignment tabs 62 are provided on the lead frame 300. The alignment tabs 62 extend outward with respect to the lead frame 300. The alignment tabs 62 can be circular members that extend outward from the insulative housing. As best shown in FIGS. 2A, 2B, the alignment tabs 62 are provided inset along the contact edge 202 of the lead frame extending outward from both sides 312, 314. Circular openings 64 are provided inset along the contact edge of each of the first and second ground shields 200, 400, aligned with the alignment tabs 62. When the lead frames 200, 400 are assembled on the lead frame 300, the alignment tabs 62 are received in the openings 64 in the first and second ground shields 200, 400. That ensures that the ground shields 200, 400 are properly aligned with the lead frame 300 and that the louvers 250, 450 are aligned with and received in the slots 350. The alignment tabs 62 are longer than the ridges 352 so that they extend outward further than (and above) the ridges 352. Thus, the alignment tabs 62 can be received in the openings 64 before the ground shield 200, 400 contacts the ridges 352.

The invention has been described as including a conductive material to bond and electrically connect the ground conductors and the two louvers (i.e., ground shields). It should be recognized however, that not all of those elements need be electrically connected. For instance, only the two ground conductors 302*a*, 302*d* can be connected; or only the two louvers. Or, none of those elements need be electrically connected, and the louvers can operate only as shields without commoning together the ground conductors and/or ground shields. In addition, the louvers need not extend all the way into the lead frame slot to align with the ground conductors, and can extend further or shallower. And a conductive conductive material need not be used. Instead, mating elements can be provided on one or more of the louvers and/or the ground conductors to physically and electrically mate with each other, or a separate mating element can be used to electrically connect two or more of those elements.

Still further, while there are two ground shields shown in the preferred embodiment, only a single ground shield can be provided, and the louver can extend partly or fully through the lead frame slot and optionally connect with the ground conductors. In addition, while the slot is shown and described as extending through the insulative housing, it can be a channel that only partially extends into the insulative housing and need not pass completely through the housing.

It is further noted that the louver tabs 252, 452 provide physical and electrical shielding to the signal conductors 302*b*, 302*c*. Thus, no additional conductive material is needed between the wafers 100. In addition, one or both of the tabs 252, 452 need not be electrically connected to the ground conductors, and the tabs 252, 452 extending from the ground layer to the lead frame layer will still provide electrical shielding of the signal conductors 302*b*, 302*c* to minimize crosstalk and signal interference.

Turning to FIGS. 8-11, the backplane 20 of FIG. 1 is shown in greater detail. FIGS. 8A-8C show the panel inserts 40 in greater detail. The panel inserts 40 are thin elongated planar conductive panels or divider walls (such as made of metal) having a top edge 46, a first side 42 with a first surface and a second side 44 with a second surface facing opposite the first surface at the first side 42. One or more chevrons 70 are formed in the panel 40. The chevron 70 can be a member, such as a beam 72 or the like, that is stamped in the panel 40. The chevron 70 is bent out of the plane of the panel 40 to be spring biased out of the plane of the panel 40. The beams 72 are elongated thin members and extend substantially transversely across the panel 40. As best shown in FIG. 8D, the beam 72 includes an angled portion 74 and a contact portion 76. The angled portion 74 bends the chevron 70 out of the panel plane into the respective backplane channel 28 (FIGS. 1, 10B), and the contact portion 76 makes contact with the ground shields 200, 400 of the daughtercard (see FIGS. 1, 2A). Thus, the angled portion 74 provides an outward bias that ensures a reliable contact between the panel 40 and the respective ground shield 200, 400. The contact portions 76 can be relatively flat, or can be curved. The panel 40 has one or more contact feet 48 along the bottom edge of the panel 40. The contacts 48 can couple with a mating region of a backplane, such as a printed circuit board.

Figure 8A:
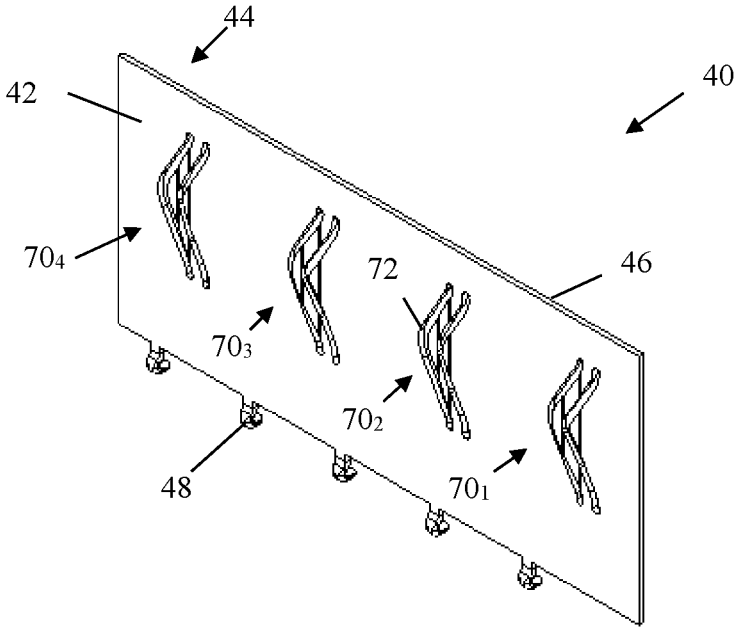
FIG. 8A is a detailed perspective drawing of the insert panel of the backplane connector shown in FIG. 1.
Figure 8B:
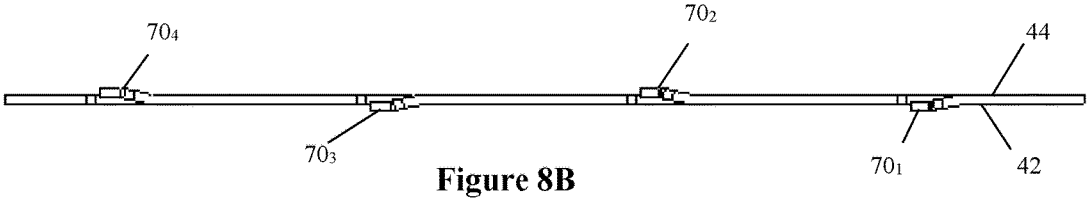
FIG. 8B is a top view of the insert panel of FIG. 8A.
Figure 8C:
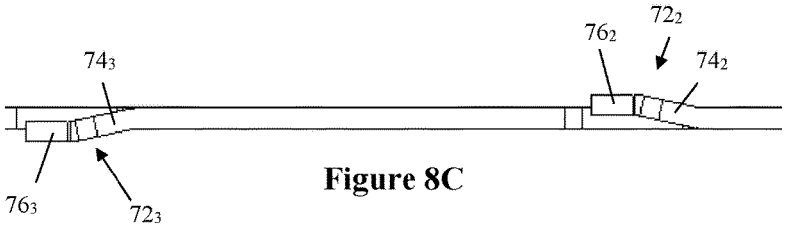
FIG. 8C is an enlarged view of a portion of FIG. 8B.

As best shown in FIGS. 8B, 8C, a plurality of chevrons $\mathbf{70}_1$-$\mathbf{70}_4$ can be provided. The chevrons 70 alternate in the direction they bend out of the plane of the panel 40. The first and third chevrons $\mathbf{70}_1$, $\mathbf{70}_3$ can extend outward from the first side 42, while the second and fourth chevrons $\mathbf{70}_2$, $\mathbf{70}_4$ can extend outward from the second side 44. Thus, the first and third contact portions $\mathbf{76}_1$, $\mathbf{70}_3$ can mate with a ground shield 200, 400 at the first side of the panel 40, and the second and third contact portions $\mathbf{76}_2$, $\mathbf{76}_4$ can mate with a ground shield 200, 400 at the second side of the panel 40.

Figure 9A:
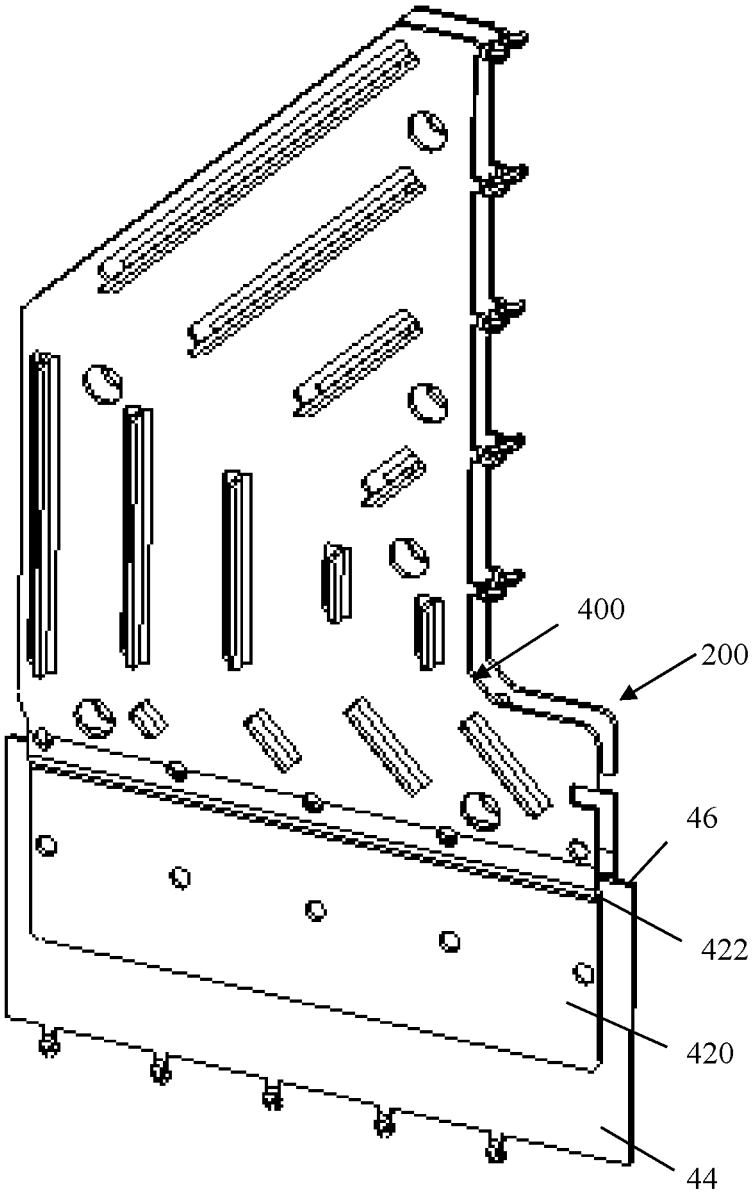
FIG. 9A is a perspective view of two neighboring ground shields coupled with a panel insert.

Turning to FIG. 9A, the panel 40 is shown connected to the first ground shield 200 of a first wafer $\mathbf{100}_1$ (see FIG. 1) and a second ground shield 400 of a second neighboring wafer $\mathbf{100}_2$ that is directly adjacent to the first wafer $\mathbf{100}_1$. As noted above with respect to FIG. 1, the wafers 100 are each received in a respective channel 28. When the daughter card connector 10 is fully mated with the backplane connector 20, the conductors 301 (FIG. 3C) mate with the backplane contacts 30 (FIG. 1). In addition, the first ground shield 200 of the first wafer $\mathbf{100}_1$ contacts the first side 42 of the panel 40, and the second ground shield 400 of the second wafer $\mathbf{100}_2$ contacts the second side 44 of the same panel 40.

Figure 9B:
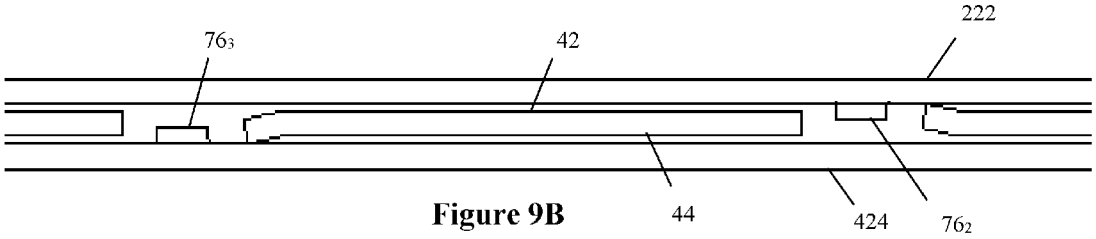
FIG. 9B is a cross-section of FIG. 9A.
Figure 9C:
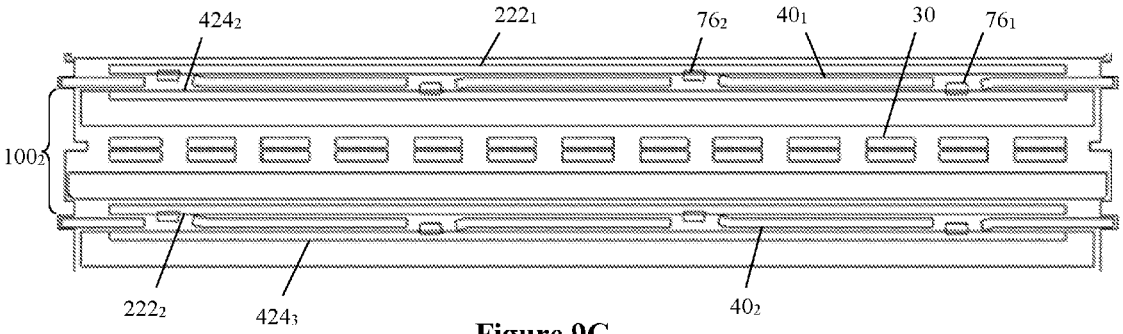
FIG. 9C is a cross-section of the backplane connector showing a wafer coupled with two panel inserts and each panel insert coupled with two adjacent wafers.

More specifically with reference to FIGS. 9B, 9C, the flat portion 424 of the contact section 420 directly contacts the first and third contact portions $\mathbf{76}_1$, $\mathbf{76}_3$ of the first and third chevrons $\mathbf{70}_1$, $\mathbf{70}_3$ at the second surface 44 of the panel insert 40. And the contact section 222 directly contacts the second and fourth contact portions $\mathbf{76}_2$, $\mathbf{76}_4$ of the second and third chevrons $\mathbf{70}_2$, $\mathbf{70}_4$. As the wafers 100 are slidably received in the channels 28, the contact section 420 and the contact section 222 push the respective chevrons 70 inward with respect to their respective panel section 40, to ensure a reliable connection between the chevrons 70 and the contact sections 420, 222. The spring bias of the chevrons 70 maintain the wafers 100 in the channels 28.

For purposes of a non-limiting illustration of the invention, two panels $\mathbf{40}_1$, $\mathbf{40}_2$ are shown in FIG. 9C. The first panel $\mathbf{40}_1$ has a first side $\mathbf{42}_1$ that is coupled with the contact section $\mathbf{222}_1$ of a first ground shield 200 of a first wafer $\mathbf{100}_1$, and a second side $44_1$ that is coupled with the flat contact section $424_2$ of the second ground shield 400 of a second wafer $100_2$. Thus, the first panel $40_1$ is a common ground for the first and second wafers $100_1$, $100_2$ in the backplane contact section, because it connects with both the first ground shield 200 of the first wafer $100_1$ and the second ground shield 400 of the second wafer $100_2$. In addition, the second panel $40_2$ has a first side $42_2$ that is coupled with the contact section $222_2$ of a second ground shield 200 of the second wafer $100_2$, and a second side $44_2$ that is coupled with the flat contact section $424_3$ of a third wafer $100_3$. Thus, the second panel $40_2$ is a common ground for the second and third wafers $100_2$, $100_3$ in the backplane contact section, because it connects with both the first ground shield 200 of the second wafer $100_2$ and the second ground shield 400 of the third wafer $100_3$. Accordingly, each wafer 100 connects to two panels 40 and its immediate neighboring wafers. As shown, the second wafer $100_2$ has a common ground with each of its immediate neighboring wafers in the backplane section, namely the first and third wafers $100_1$, $100_3$, so that the mating interface provides a common ground from one daughtercard wafer 100 to the neighboring daughtercard wafer 100.

The use of the common grounded panels 40 in the mating interface provides the advantage of conductive paths for the ground currents from two sides of each wafer, while on average taking up the space of only a single panel thickness because each single panel is configured to simultaneously contact ground shields on two separate but adjacent wafers. The alternative of using a separate panel-type ground contact to mate with ground conductors on each side of each wafer would require twice as many panel-type contacts, leading to higher cost and lower interconnect density. A further advantage provided by using grounded panels shared by two wafers is that such panels also serve to electrically connect or bridge the ground shields of adjacent wafers in the electrically important region of the separable mating area of the connector, where the alternative configuration of non-bridged ground shields of adjacent wafers can form part of a resonant cavity that degrades electrical performance by increasing crosstalk and reflections, and decreasing signal transmission at frequencies near the resonance of said cavity. The overall effect in the mated connector is to provide a single electrically integrated conductive ground shielding structure for isolating from each other all the signal paths passing through the mating interface area of the connector assembly.

Figure 10A:
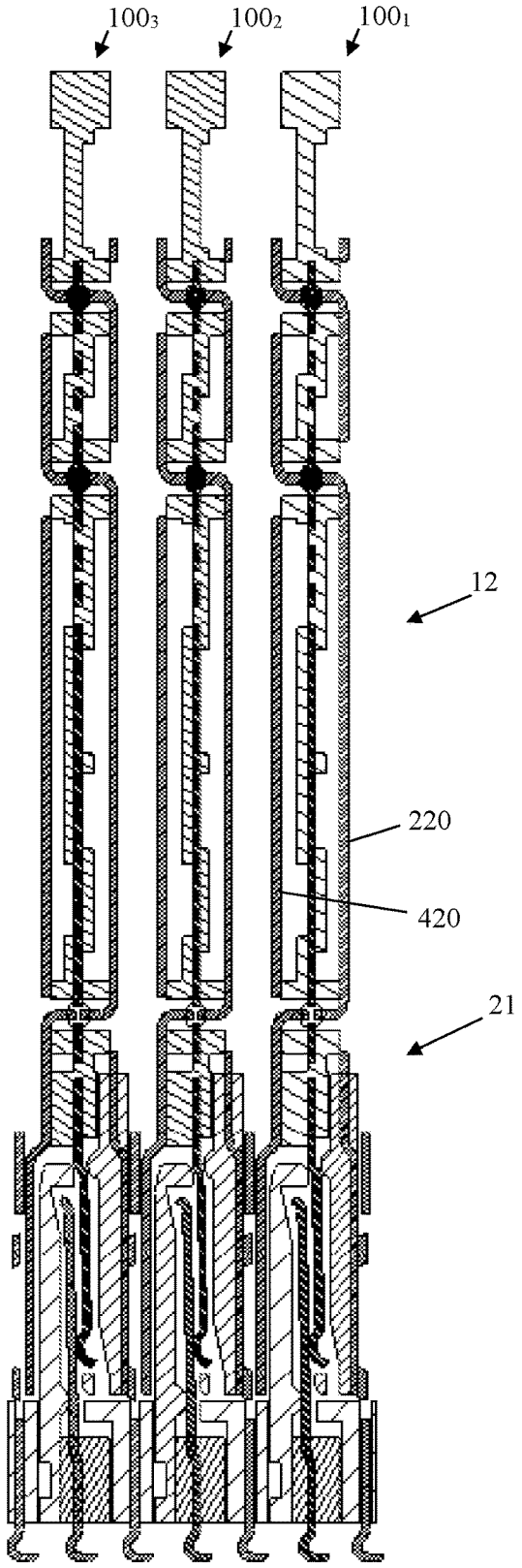
FIG. 10A is a cross-sectional side view of wafers having a common ground in the daughtercard and backplane sections.

Turning to FIG. 10A, a cross-section of the wafers $100_1$, $100_2$, $100_3$ is shown, including both the daughtercard section 12 and the backplane section 21. As described with respect to FIGS. 2-7 above, each wafer 100 has ground shields 220, 420 that are coupled together and with the ground conductors in the daughtercard section 12. And as described with respect to FIGS. 8-9 above, each wafer 100 is coupled to a ground panel 40 and the neighboring wafer, in the backplane section 21. Thus, a more complete ground is provided of the entire daughter card connector 10 (FIG. 1) to provide a more uniform ground throughout each wafer 100 and the lead frames 300. That provides more uniform signals on the signal conductors of the lead frames 300.

Figure 10B:
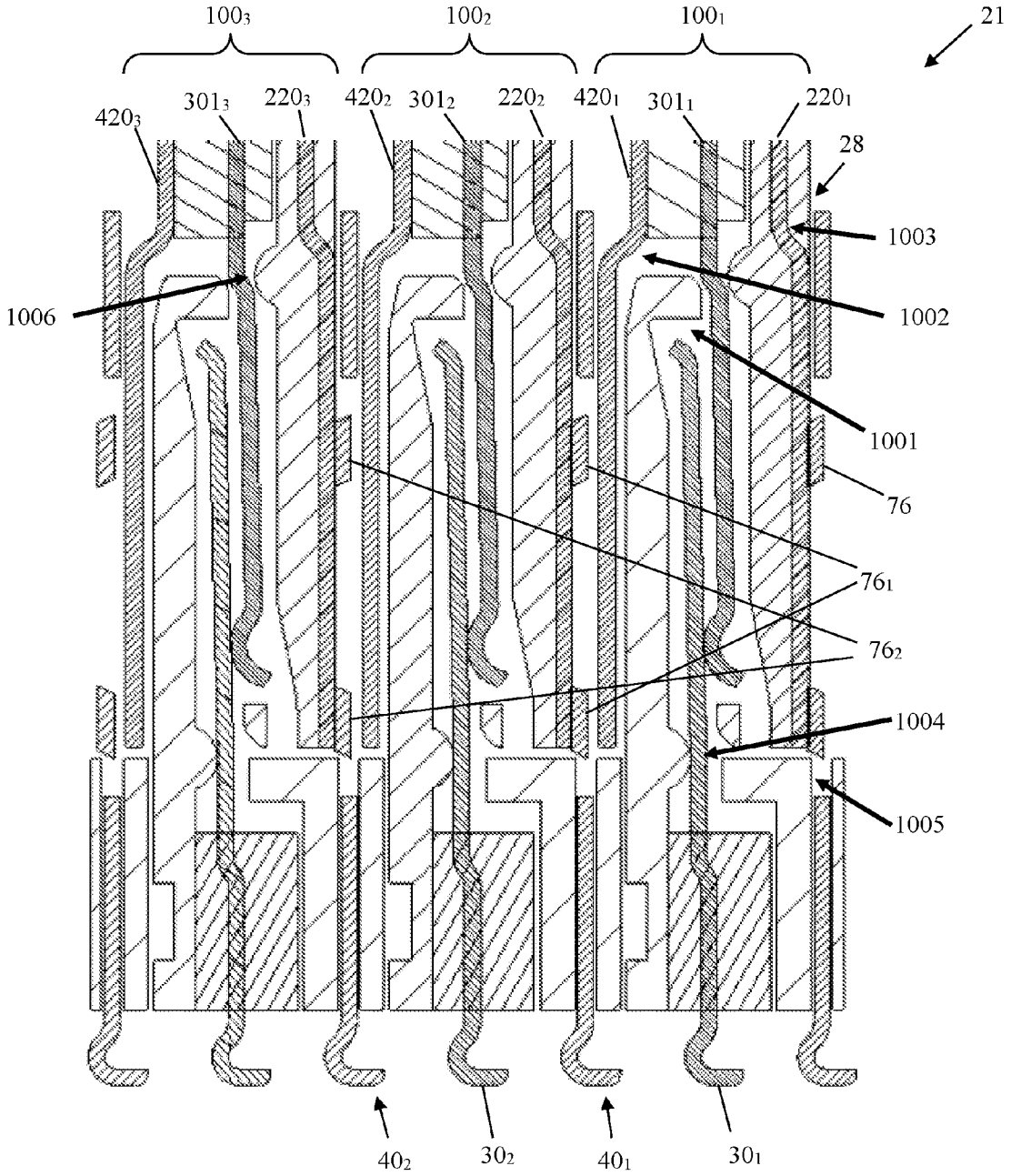
FIG. 10B is an enlarged view of the backplane section of FIG. 10A.

In FIG. 10B, a detailed view of the backplane section 21 is shown. Before the wafers 100 are received in the channels 28, the chevrons 70 project outward into the respective channel 28 of the backplane connector 20. Once the wafer 100 is fully received in the channel 28, as shown, the chevrons 70 are pressed backward toward the panel 40. The conductors $301_1$, $301_2$, $301_3$ of the wafers $100_1$, $100_2$, $100_3$ slidably engage the backplane contacts $30_1$, $30_2$, $30_3$. In addition, the plates of the contact sections 220, 420 engage the panels 40.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. An electrical assembly comprising:

a lead frame having at least two elongated ground conductors separated by at least one slot, said lead frame having a first side and a second side opposite the first side;

a first ground shield at the first side of said lead frame, said first ground shield defining a first plane and having a first integral louver extending out of the first plane; and a second ground shield at the second side of said lead frame, said second ground shield defining a second plane and having a second integral louver extending out of the second plane, wherein the first integral louver extends to the at least one slot at the first side of said lead frame and the second integral louver extends to the at least one slot at the second side of said lead frame, wherein the first integral louver is positioned above the first ground conductor at the first side of the lead frame and the second integral louver is positioned above the second ground conductor at the second side of the lead frame.

2. The assembly of claim 1, wherein the lead frame is sandwiched between said first ground shield and said second ground shield.

3. The assembly of claim 2, wherein said lead frame has an insulative housing with a housing slot being formed in the insulative housing, and the first louver of the first ground shield and the second louver of the second ground shield each extend at least partially into the housing slot.

4. An electrical assembly comprising:

a lead frame having at least two elongated ground conductors separated by at least one slot, said lead frame having a first side and a second side opposite the first side;

a first ground shield at the first side of said lead frame, said first ground shield defining a first plane and having a first integral louver extending out of the first plane; and a second ground shield at the second side of said lead frame, said second ground shield defining a second plane and having a second integral louver extending out of the second plane, wherein the first integral louver extends to the at least one slot at the first side of said lead frame and the second integral louver extends to the at least one slot at the second side of said lead frame, further comprising a conductive material in the at least one slot and electrically bonding the first louver of the first ground shield and the second louver of the second ground shield.

5. The assembly of claim 4, said at least two ground conductors includes at least one ground conductor exposed in the slot, said conductive material electrically bonding the ground conductor with the first louver of the first ground shield and the second louver of the second ground shield.

6. An electrical assembly comprising:

a lead frame having a plurality of elongated conductor sets, and an insulative housing, each conductor set having two differential signal pair conductors between a first ground conductor and a second ground conductor, said lead frame having a first side and a second side opposite the first side;

a slot extending completely through the insulative housing to define a first opening on the first side of the lead frame and a second opening on the second side of the lead frame, said slot positioned between a first and second neighboring conductor sets and at least partially exposing the first ground conductor of the first conductor set and the second ground conductor of the second conductor set;

a first ground shield extending along the first side of the lead frame, said first ground shield having a first main body and a first tab bent inward from the first main body into the first opening of the slot of said lead frame; and a second ground shield extending along the second side of the lead frame, said second ground shield having a second main body and second tab bent inward from the second main body into the second opening of the slot of said lead frame.

7. The assembly of claim 6, wherein said lead frame is planar and located in a first plane and said ground shield is planar and located in a second plane substantially parallel to the first plane.

8. The assembly of claim 6, wherein the differential signal pair conductors, first ground conductor and second ground conductor extend substantially parallel to each other.

9. The assembly of claim 6, said assembly comprising a wafer.

10. The assembly of claim 9, further comprising a plurality of wafers substantially parallel to each other.

11. A method comprising:

providing a lead frame having an insulative housing, two elongated ground conductors having a ground slot therebetween, a first side having a first housing slot in the insulative housing and a second side opposite the first side having a second housing slot in the insulative housing;

providing a first ground shield defining a first plane;

providing a second ground shield defining a second plane;

cutting or stamping a first louver in the first ground shield;

cutting or stamping a second louver in the second ground shield;

bending the first louver out of the first plane of the first ground shield toward the lead frame and into the first housing slot and to the ground slot; and bending the second louver out of the second plane of the second ground shield toward the lead frame and into the second housing slot and to the ground slot.

12. The method of claim 11, further comprising sandwiching the lead frame between said first ground shield and said second ground shield.

13. An electrical assembly comprising:

a lead frame having a first side and a second side opposite the first side, further comprising a first ground conductor at the first side and a second ground conductor at a second side;

the lead frame having at least one signal conductor extending longitudinally and having a first edge and a second opposing edge;

a first ground shield at the first side of said lead frame, said first ground shield having a first integral louver extending along the first edge of said at least one signal conductor from the first side of said lead frame; and a second ground shield at the second side of said lead frame, said second ground shield having a first integral louver extending along the first edge of said at least one signal conductor from the second side of said lead frame, wherein the first integral louver is positioned above the first ground conductor at the first side of the lead frame and the second integral louver is positioned above the second ground conductor at the second side of the lead frame.

14. The assembly of claim 13, said first ground shield having a second integral louver extending along the second edge of said at least one signal conductor from the first side of said lead frame, and said second ground shield having a second integral louver extending along the second edge of said at least one signal conductor from the second side of said lead frame.

15. The assembly of claim 13, said at least one signal conductor comprises two signal conductors forming a differential signal pair.

16. The assembly of claim 1, wherein the lead frame is comprised of at least one ridge, wherein the at least one ridge spaces the first ground shield and the second ground shield from the lead frame.

17. The assembly of claim 6, wherein the lead frame is comprised of at least one ridge, wherein the at least one ridge spaces the first ground shield and the second ground shield from the lead frame.

18. The method of claim 11, wherein lead frame is comprised of at least one ridge, wherein the at least one ridge spaces first ground shield and the second ground shield from the lead frame.

* * * * *